US006571947B1

(12) United States Patent
Rogers

(10) Patent No.: US 6,571,947 B1
(45) Date of Patent: Jun. 3, 2003

(54) GOLF BAG PUTTER HOLDER UTILIZING STUFFED TOY DOLLS

(76) Inventor: Thomas Lee Rogers, 1595 Rivergardens Dr., Bullhead City, AZ (US) 86442

( * ) Notice: Subject to any disclaimer, the term of this patent is extended or adjusted under 35 U.S.C. 154(b) by 0 days.

(21) Appl. No.: 10/184,662

(22) Filed: Jun. 27, 2002

(51) Int. Cl.[7] ..... A63B 57/00

(52) U.S. Cl. ..... 206/315.2; 206/315.6; 150/160; 211/70.2

(58) Field of Search ..... 211/70.2; 206/315.2, 206/315.6; D21/754; 446/72, 73; 150/160

(56) References Cited

U.S. PATENT DOCUMENTS 4,055,207 A * 10/1977 Goodwin ..... 206/315.6
4,497,404 A * 2/1985 Lowrance ..... 206/315.2
5,005,624 A * 4/1991 Sung ..... 150/160
D318,705 S * 7/1991 Arato ..... D21/221
5,437,320 A * 8/1995 Sung ..... 150/160
5,816,396 A * 10/1998 Shin ..... 206/315.3
D403,726 S * 1/1999 Colinelli ..... D21/754
D417,899 S * 12/1999 Sloan ..... D21/754
6,113,457 A * 9/2000 Kociemba ..... 446/297
6,244,437 B1 * 6/2001 Rogers ..... 206/215.2
6,343,692 B1 * 2/2002 Park ..... 206/315.2

* cited by examiner

*Primary Examiner*—Sue A. Weaver

(57) ABSTRACT

Disclosed is a golf bag putter holder utilizing a bean bag, plush or stuffed toy doll as the principal means of protecting the putter head from damage. A putter holder that under normal transportation and golf play, when attached to a conventional golf bag by a clip, will suspend a putter above the bag floor and secure a putter head firmly in place. The holder is comprised of a tube for mounting a doll and storing the putter. The tubes top aperture contains notches to seat a club head in place, thus eliminating the need to remove and replace a head cover. A plain version of the holder is disclosed as well.

3 Claims, 5 Drawing Sheets

GOLF BAG PUTTER HOLDER UTILIZING STUFFED TOY DOLLS

BACKGROUND OF THE INVENTION

This invention relates generally to an improved device, which holds a golf club putter protectively in place within any type of conventional golf bag. More particularly, an invention that stores, aligns, segregates and protects a putter within a golf bag and mounts a stuffed toy or a plain version thereof, on a rigid elongated tube as the principal means to protect the putter head from damage.

A class of devices exists for storage and protection of golf clubs. An example is U.S. Pat. No. 5,005,624 issued to H. Sung, which shows a golf club protector, adapted to be permanently retained in a conventional golf bag. The protector comprises a rigid elongated tube mountable in a golf bag and a flexible fabric cover attached to the upper end of the tube for encircling the head of the club. Sung improved upon his original protector in his U.S. Pat. No. 5,437,320 whereby the principal feature was the addition of a flanged panel adapted to underlay the toe area of the head of an inverted golf club and a flanged hood adapted to overlay the sole area of the club.

These concepts are used extensively for golf club woods and have been applied to the putter as well. Typically, nylon fabric is covered in a high pile acrylic fur to form a protective hood and often a sock extends downward to partially protect the shaft. Many such hoods take the form of an animal. These animal representations upon a golf club device have been proven to be a highly desirable feature. These hoods, socks or padded head covers provide excellent protection but have no other practical function and are easily misplaced or lost. Examples are D 446,564 and D 444,525.

My issued U.S. Pat. No. 6,244,437 shows a universal golf bag putter holder that, when attached to the upper lip of a golf bag, will enable storage, alignment, segregation and protection for the shaft and the putter's club head. These features are accomplished by utilizing a tube, clip and padding material, that creates a resting place for the putter head in lieu of a hood type arrangement. The tube is open at both ends to allow a putter shaft to descend and reside therein with the tubes upper opening containing a singular notch to lock in a putter head. The tube's top end being horizontal and the padding being of foam rubber covered with a mid-pile fuzzy nylon material in an upward angled position. A slot is created in the padding material to form a resting place for the putter head and the clip is positioned on the tube starting at its top and is adhesively attached to the tube.

BRIEF SUMMARY OF THE INVENTION

Heretofore, no protective putter device existed that could reasonably take the form of a six to nine inch length stuffed toy animal or cartoon character as well as have other practical storage applications. The problem encountered is most stuffed toys are not meant to be elevated or suspended. They are designed to lay, stand, or sit on a flat surface and tend to deform, droop or look unnatural when mounted or attached to a putter storage device, particularly those that are filled primarily with plastic pellets. This problem has been overcome in the present invention.

The present invention relates to a putter holding device of the type disclosed in my U.S. Pat. No. 6,244,437. A putter holder is revealed that utilizes a stuffed toy as the principal means to protect a putter head from damage. The tube, clip and padded material concepts are retained, however, multiple design changes have been made to improve upon the previous inventions holding ability and other changes that enable the mounting of stuffed toys with little or no deformation and a realistic look. A novel piece of cloth has been conceived that when added to a doll, allows a doll to be mounted on a uniquely shaped tube top aperture. The tube's clip has been redesigned and relocated at a lower position to act as a stop, thus eliminating the need for a screw and the addition of multiple new types of cushioning materials utilized. In the present invention the tube and clip are preferably made by injection molding process. An additional notch in the tube is incorporated and the tubes upper opening is made on an angle rather than horizontally. Outer covering materials commonly found in the stuffed toy industry have now been employed. The circular cutout made a complete rather than a partial material cutout. The material slot has been eliminated. and replaced by an indentation in the material that resists putter head movement. Other design changes have been made which will become evident upon review of the detailed description. The objective is to allow the placement of plush stuffed animal type dolls, bean bag toys, and cartoon type dolls upon a putter holding device for the purpose of greatly enhancing a holders desirability and at the same time use the body, head, legs, arms, wings and other body parts as a separator from other stored golf clubs.

An animal representation made slightly elevated and supported in a tilted position upon a golf bag, as is the case in the present invention, enables the presentation of an entire body and complete exposure of the face. This gives a much more natural look, as well as the ability to mount thousands of differing doll configurations regardless of their original position intent, including the classic six-inch beanbag dolls, which are highly prized in our society and have, indeed, become collectibles.

A further objective is to use existing doll fabric patterns, by adding an opening through the main body panel parts, which does not cause a major pattern change or the need for a new doll design configuration to accommodate the holder. It is also an objective to leave unchanged any doll manufacturers basic doll interior stuffing preferences to make the invention herein described applicable to the universe of stuffed dolls that are of a practical size for use upon a golf bag. A plain and unattractive version is described as well, which incorporates the improvements over my prior invention. While this plain version is not as effective as a doll in protecting the putter, a compromise is made to appeal to those golfers who are conservative in nature and would be opposed to placing a doll on their golf bags.

BRIEF DESCRIPTION OF SEVERAL VIEWS OF THE DRAWINGS

The objects and features of the invention may be understood with reference to the following detailed descriptions of preferred embodiments of the invention, taken together with the accompanying drawings as follows.

DETAILED DESCRIPTION OF THE INVENTION

Reference now should be made to the drawings, in which the same reference numbers are used throughout the different figures to insure reference to the same components. In addition, the subject matters of U.S. Pat. No. 6,244,437 are incorporated herein.

Figure 1:
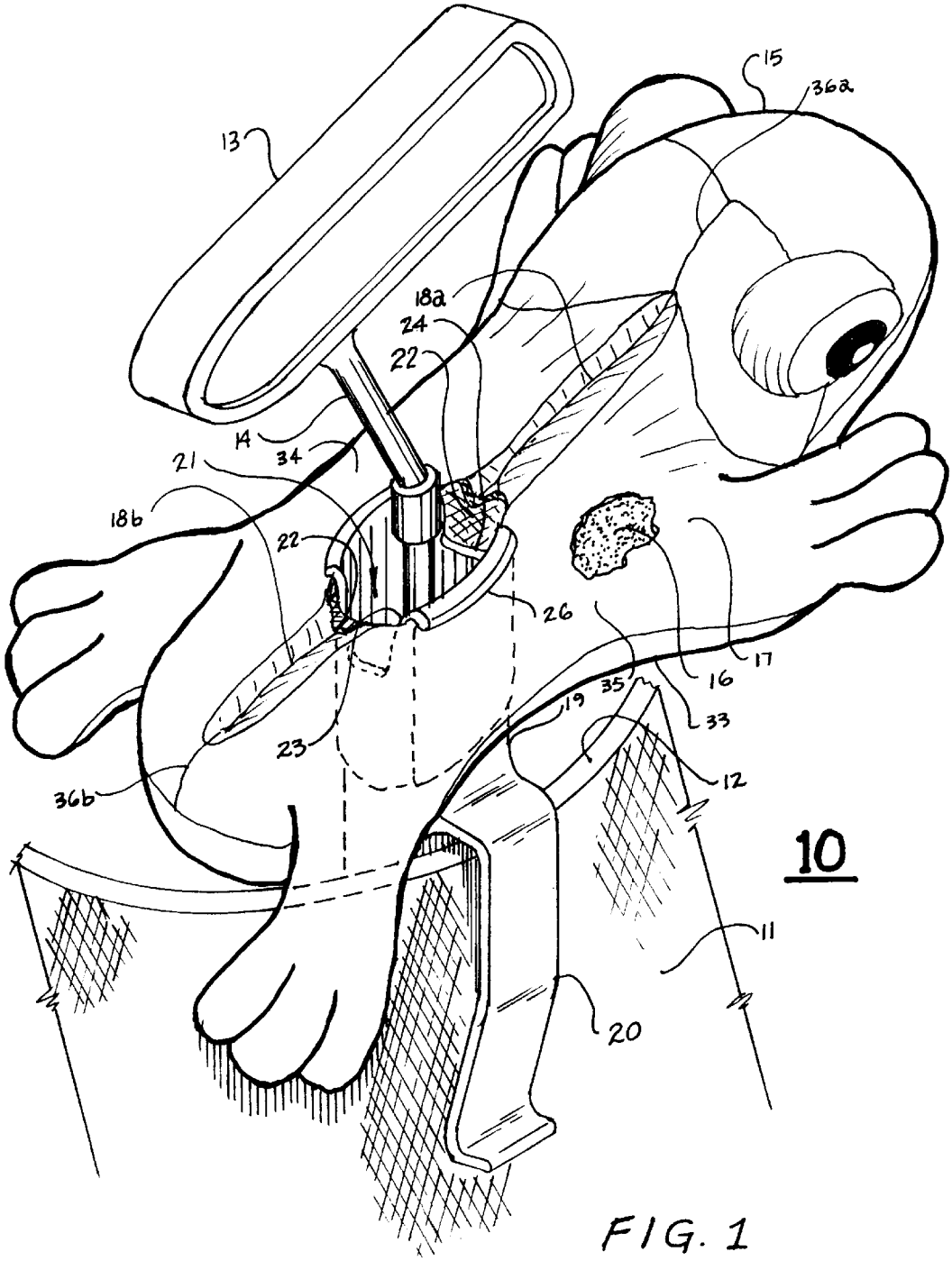
FIG. 1 An isometric view of the putter holder placed upon a conventional golf bag viewed from outside a bag.

FIG. 1 shows the use of the putter holder 10 attached to a conventional golf bag 11 above and parallel to its rim 12. A conventional blade putter head 13 and its putter shaft 14 are depicted just prior to resting upon the rendering of a typical seven inch stuffed doll. The type and size of doll to be utilized is a design choice, which must be reasonable to meet the stated objectives. 10 is attached to 11 by clip means best shown in FIG. 2*a*. Holder 10 consists of a cushioning member doll 15 which may contain a variety of stuffing materials 16, as commonly employed in the plush toy, stuffed doll and beanbag toy industries, as well as semi-soft synthetics of differing density characteristics, preferably polyester fiber in combination with polyethylene pellets. Material 16 may be covered by a variety of textiles commonly employed in the toy industry, preferably nylon based acrylic plush fur 17, which provides structure, longevity and aesthetics. Indentation 18*a* and 18*b* are created by the weight of the putter head resting upon soft material 16 and 17, to aid in the prevention of putter vibration once placed therein. An elongated tube 19 is open at both ends and is sufficiently sized to receive a putter shaft and its handle. 19 may be formed from conventional well-known resilient materials, such as common plastics or rubber compounds. The preference would be a plastic synthetic resin such as a polyolefin copolymer or propylene, etc. The tube 19 and its clip 20 are best formed as one unit, utilizing the manufacturing process of injection molding. An opening 21 exists in 16 and 17 to accommodate the 15 attachment mechanism to 19, which is a tubular shaped cloth sleeve portion 22 of 15, and is more clearly shown in FIG. 3. Opening 21 is preferably located slightly to the rear of the top dead center of 15 to make an accommodation for the difference in length between the toe and heel of most putter heads in relation to their shafts.

Figure 2A:
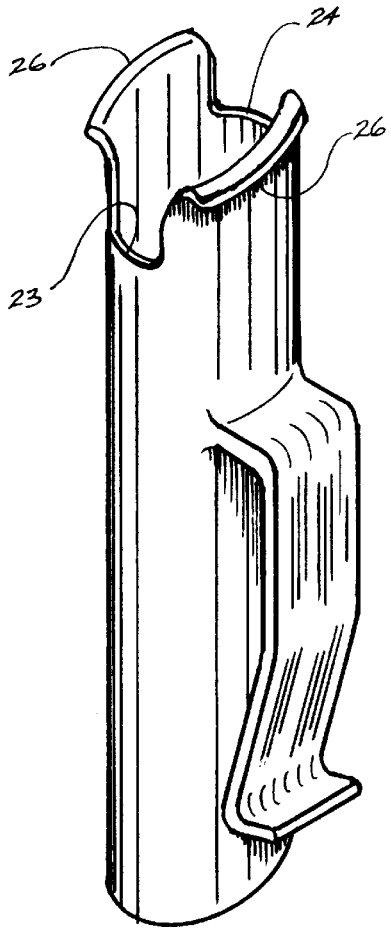
FIG. 2*a* An isometric view of the tube and clip portion of the putter holder.
Figure 2B:
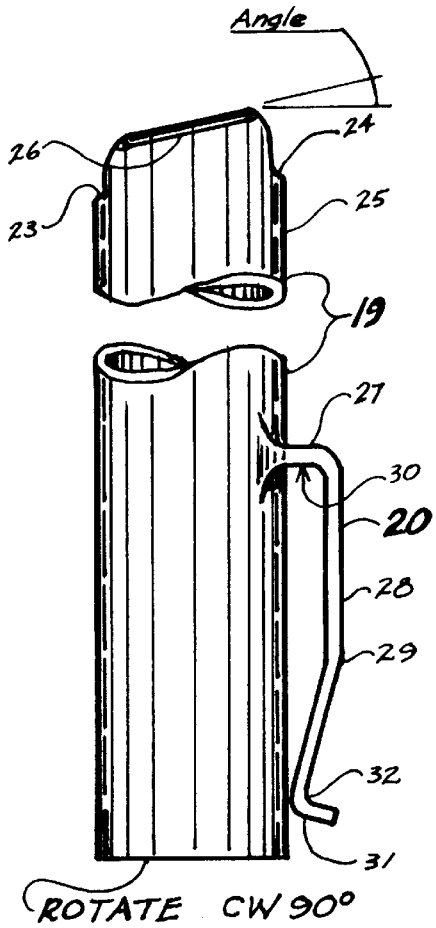
FIG. 2*b* A side isometric view of the tube and clip with a portion rotated to show an angle.

FIGS. 2*a* and 2*b* reveals that 19 contains notches 23 and 24, approximately the width of a typical 13, at tube top end 25 to provide the means to lock a putter head into 10. The depth of 23 and 24 are such that when a putter is placed therein, a portion of the putter head rests upon the notches. Therefore, a portion is exposed and a portion contacts 17. While it is desirable to have a notch that will accept as many differing putter bead shapes as possible, it may be desirable to more securely retain a particular putter by modifying the size and contours of either 23 or 24 conforming to their particular size and contours. Notch 23 and 24 are diametrically opposed to one another with 23 lower than 24. The rim of tube top 26 is canted starting at 23 and proceeds upward to 24 the same degree found in a typical putter between the shaft and the head. The tubes lower end is horizontal. It is preferred that the edges of 23 and 24 be rounded to assure no sharp edges could damage a putter face. 26 is preferred to be a flanged rim to provide a broader point for the users aim, prevent damage to the 17 material caused by misuse and to insure that a 15 cannot be removed easily from 19. The notched edges may be rubberized if preferred and 19 lengthened to accommodate the non-conventional long shafted putters.

As shown in FIG. 2*b* a clip 20 is integral to 19. 20 has an upper portion 27, which is relatively rectangular in shape and extends outwardly from 19, a sufficient distance to fit over rim 12. Portion 27 is structurally thicker than its leg portion 28. Leg 28 is relatively straight, rectangular in configuration and angled inwardly toward 19 by a bend 29 in the material, which together provide the force and spring-like effect in such elastomer type flexible plastic clips. Clip 20 is located on 19, a predetermined distance from the lowest portions of 26 compatible with the length of the average putter shaft and golf bag with 19 short of a golf bag floor. The underside of 27 is a flat surface 30, designed to be in contact with 12 and acts as a stop feature for the entire holder 10 and additionally allows space for a 15 to be mounted. Tube 19 and its clip 20 provide the means by which 10, with a putter resting therein, may be raised above the rim of any conventional golf bag with a putter in suspension, the weight of a putter upon notches 23 and 24 and proper alignment within a golf bag of a putter occurring. Leg 28 at its lower free end 31 is nearly even with the surface of 19 and must be physically separated when 10 is being attached to a golf bag. Leg 28 contains an outward bend 32 in the material as a convenience for the user. While tube 19 is described for use inside a golf bag and clip 20 on the outside, a user may reverse this arrangement and have 19 without a golf bag and 20 inside, with a putter shaft 14 hanging outside bag 11 to gain greater separation of a 13 from other stored clubs.

FIG. 1 suggests that at least eight individual panel pieces of 17 materials are necessary to produce a doll by manufacturers skilled in the art. The first piece of a doll is normally a bottom body panel 33 of the skin and sets the foundation for the rest of the outer panels. Two additional body panel pieces, a right 34 and left 35, normally form the sides and back with connecting internal side seams and a top seam 36*a* and 36*b*.

Figure 3:
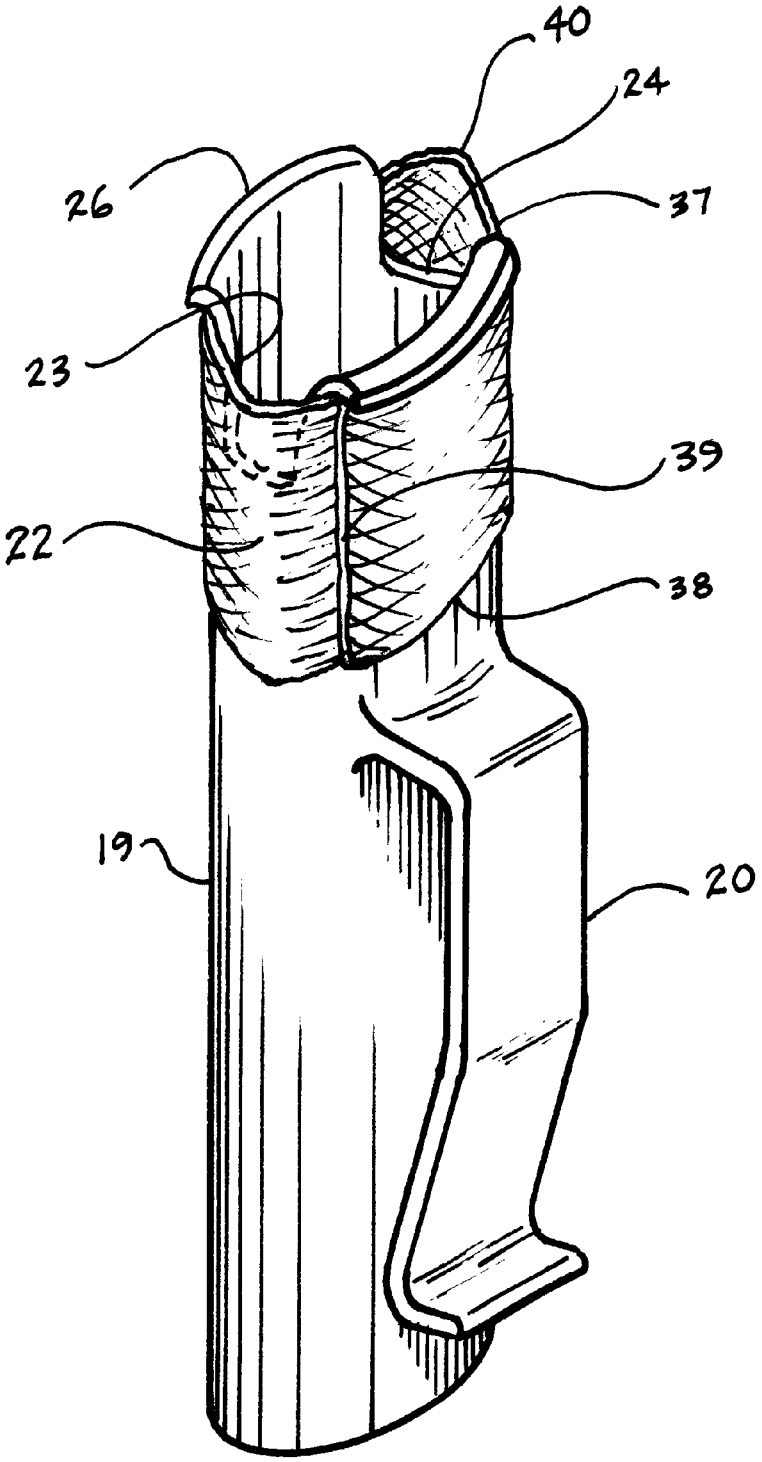
FIG. 3 An illustration of a tubular cloth configuration.

FIG. 3 depicts a cloth sleeve piece 22 that is to be connected to panel's 33, 34, 35 by a stitching process. Their seam 36*a* and 36*b* create the holders cushioning member 15 and its opening 21. Piece 22, preferably a fabric combination of nylon and spandex, which will surround 25 of 19, is open at both ends, has an upper first end 37 and a lower second end 38 both of which are canted the same as 26 with a connecting seam 39. The height of 22 is found in a typical doll between its bottom panel and back, with the apex 40 of 22, when sewn to the panels, is in alignment with 36*a*. Opening 21 is created from existing fabric patterns by modifying 34 and 35, cutting a 19-sized half circle in the fabric, then making a series of clips in the round and stitching them to an overlap fold in 37. An opening is formed in 33 by cutting a complete series of clips in the round of a 19-sized circle in the fabric and making a stitching connection to an overlap fold in 38. It is to be recognized that in some doll patterns, a seam may run through a bottom panel as well. As the exterior of 15 takes place, the head, ears legs etc., are sewn on, and stuffed with 16 materials. When accomplished, doll accessories are finalized and made ready for attachment by hand to 25. To assure 15 becomes a permanent part of 10, an adhesive is placed on 25 and a slightly smaller diameter 22 than 19 utilizes the stretching qualities of cloth, to force a tight fit. In the preferred embodiment, panels 34 and 35 are flush to the underside of rim 26, the legs of a 15 made slightly splayed outward, a tail curved towards the stored golf clubs or a wing made in a more upright position by very slight stitching adjustments, Body parts are made thick, firm or exaggerated by the amount of 16 materials utilized, depending on the doll selected, solely for the purpose of insuring protection of the putter head from other stored golf clubs.

Figure 4:
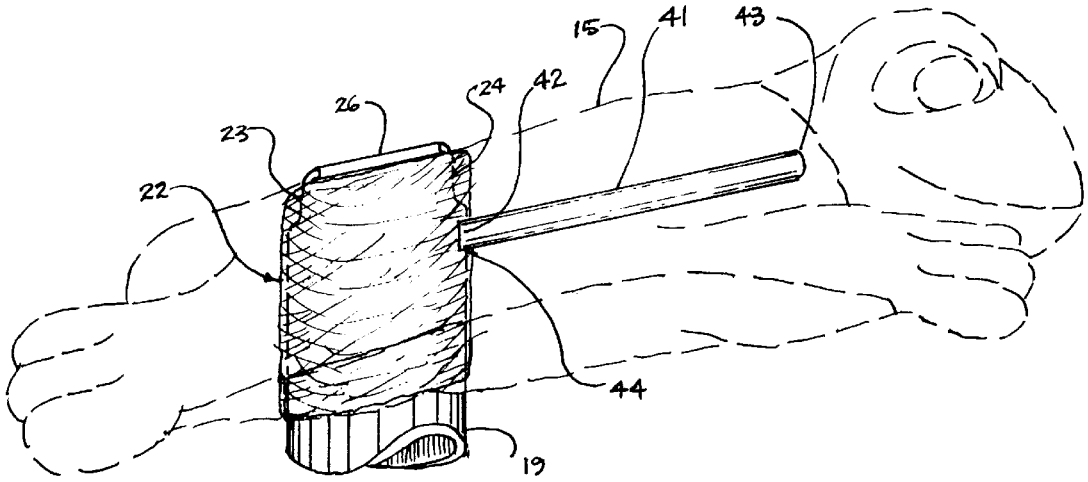
FIG. 4 A side view of an embodiment that utilizes a stiffening member.

When it is desired to utilize a doll that contains minimal amounts of stuffing material or one that is primarily filled with plastic pellets, a stiffening member is added to 19 to overcome a dolls tendency to droop and appear unnatural. FIG. 4 depicts an embodiment wherein a substantially elongated rectangular stiffening member 41, being of plastic, rubber, Styrofoam or other similar material, is made permanent to 19 by an adhesive or, preferably, by injection molding of a plastic synthetic resin, starting at the lower portion of 24 and extending upward on an angle the same as 26 through a dolls central body part and into a portion of its head. In order to mate against 19, end 42 of 41 is of a concave configuration with end 43 being blunt. The size of 41 is a design choice, which must be reasonably sufficient to overcome the weight of plastic pellets or compensate for the lack of stuffing materials. An opening 44 in 22 is necessary to allow a 15 to pass through 41 when being mounted to 19, with a slit in the fabric being sufficient.

Figure 5:
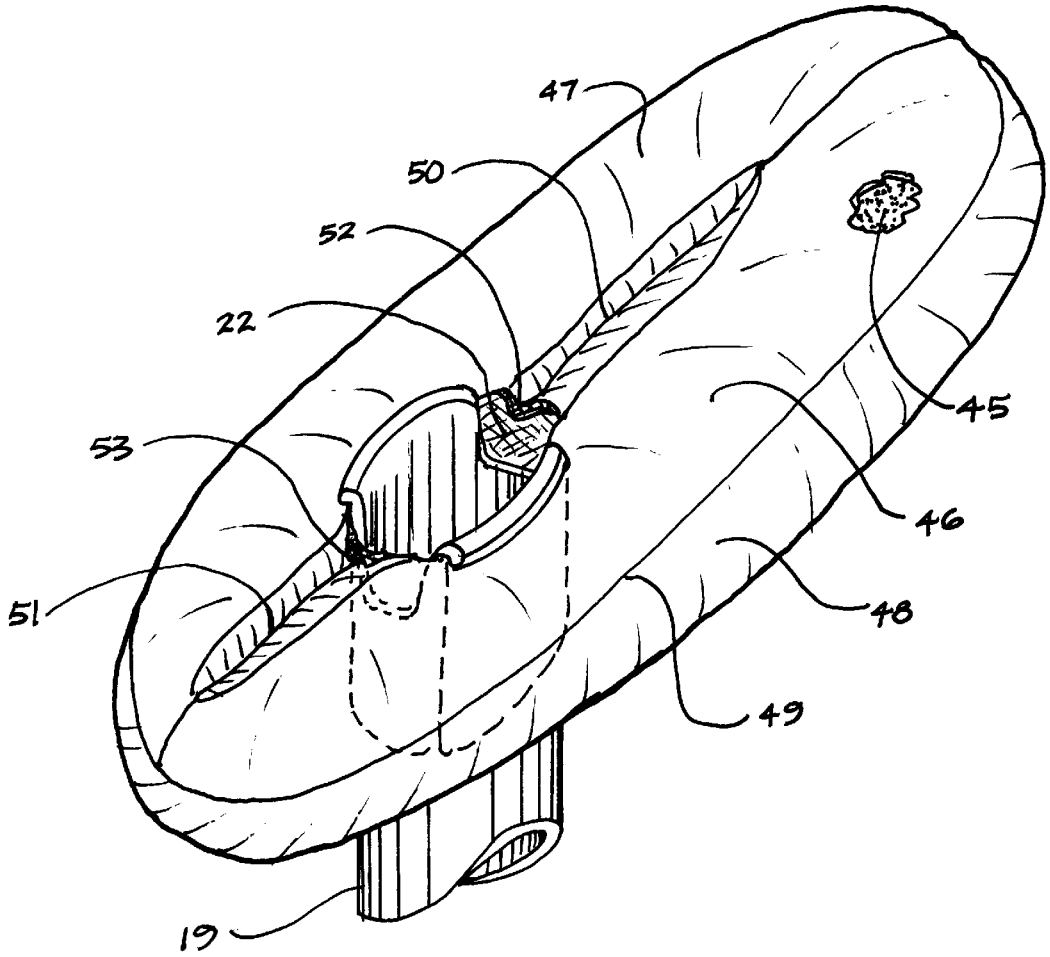
FIG. 5 An isometric view of an alternate embodiment of the invention.

In an alternate embodiment, as depicted in FIG. 5, a plain and substantially rectangular version of 10 may be produced with the design changes stated above for the tube 19 and its clip 20. The internal cushioning material 45, being vulcanized rubber, synthetic fibers or other semi-soft flexible material, preferably cotton. The outer covering panels 46, 47 and 48 being of various textiles such as wool or leather but preferably nylon backed acrylic fur. 45 may be covered by a number of stitching means by those skilled in the art, preferably by joining a right panel 46 and a left panel 47, which form the sides and top and a bottom panel 48 and connecting them to a 22 in the same manner as previously described. Internal seams 49, 50 and 51 join the panels, with seam 50 and 51 intersecting 22 at 52 and 53. The overall size being a design choice determined by the amount of stuffing material one wishes to use to protect the putter head.

While the invention has been described in connection with the preferred embodiments, it is understood that I did not intend to limit the invention to that embodiment. On the contrary, it is intended to cover all alternatives, modifications and equivalents as may be included within the spirit and scope of the invention as defined by the appended claims. It should be apparent to those skilled in the art that other stitching means may be employed, the cloth made to extend down the tubes outer or inner surface, the clip reconfigured, tube notches made narrow or angled, the holder made specifically for an iron club with slight modification or additional stiffening members added.

What is claimed is:

1. A golf club putter holder for attachment to a golf bag, comprising:

a) an elongated rigid tube member of a resilient material, first and second ends oppositely and longitudinally disposed on said tube, said first end being open and adapted for receiving a golf club putter shaft, with two opposing notches formed in said first tube end, said notches being sized to accept a portion of a putter head, said first tube end being on an angle the same degree as found in a typical putter between its shaft and head, said notches and said tube angle acting in cooperation so as to prevent a putter head when placed therein from substantial movement, said second end being horizontal and open to allow a putter shaft and handle to descend within or without a golf bag for vertical alignment with a golf bags inner or outer sidewall b) a flexible clip member of a resilient material integrally made part of said tube, said clip comprising a portion that is relatively rectangular in configuration and structurally thicker than its portion leg, which is spaced apart from said tube and extends downwardly on an angle toward said tube to produce a spring-like tension capable of stabilizing said holder upon a golf bag, with a portion of said clip acting as a stop that elevates a portion of said tube above the rim of a golf bag a sufficient distance to cause a putter when placed in said holder to reside in a suspended manner, when said holder is attached to the rim of a golf bag;

c) a cushioning member doll formed from a multiplicity of bean bag, plush, and stuffed toys, for partially surrounding and contacting a putter head, said members head, body and appendages acting as a protective device when mounted on said tube, said member being substantially irregular in shape and having a cloth sleeve portion extending from the top surface to the bottom surface of said doll, with said portion having a first and second end opening and being adapted to engage upon said tube when made an integral part of said cushioning member doll.

2. The holder of claim 1, with a substantially rectangular shaped stiffening member of a resilient material made integral to said tube, with said member extending upwardly from said tube through the body and into the head of said doll and acting to prevent deformation of said doll when mounted on said tube.

3. A devise for protecting a putter head from damage, comprising:

a) a cylindrical shaped rigid tube open at both ends for receiving a putter shaft;

b) said tube having a clip for attachment to a golf bag;

c) a plain cushioning member which partially surrounds and contacts a putter head, containing an inner fiber stuffing and an outer covering of a soft pliable material, said member being substantially rectangular in shape and presenting a top surface and opposing bottom surface, said member having a cloth sleeve portion extending from the top surface to the bottom surface of said cushioning member, with said portion having a first and second end opening and being adapted to engage upon said tube when made an integral part of said cushioning member.

* * * * *